United States Patent [19]

McCullough et al.

[11] Patent Number: 4,502,979

[45] Date of Patent: Mar. 5, 1985

[54] CORROSION INHIBITORS FOR ALKANOLAMINE GAS TREATING SYSTEMS

[75] Inventors: John G. McCullough, Hawthorne; Kenneth J. Barr, Yonkers, both of N.Y.

[73] Assignee: Union Carbide Corporation, Danbury, Conn.

[21] Appl. No.: 444,980

[22] Filed: Nov. 29, 1982

Related U.S. Application Data

[63] Continuation of Ser. No. 163,975, Jun. 30, 1980, abandoned.

[51] Int. Cl.[3] ..... C23F 11/18; C09K 3/00

[52] U.S. Cl. ..... 252/389 R; 252/394; 252/388

[58] Field of Search ..... 252/389 R, 388, 389, 252/394, 393, 389.1–389.6; 423/228, 229

[56] References Cited

U.S. PATENT DOCUMENTS

| | | | |
|---|---|---|---|
| 3,808,140 | 4/1974 | Mago | 252/389 |
| 3,851,041 | 11/1974 | Eickmeyer | 423/223 |
| 3,896,044 | 7/1975 | Mago | 423/229 |
| 3,951,844 | 4/1976 | Mago | 252/389 R |
| 3,959,170 | 5/1976 | Mago | 423/229 |
| 4,371,450 | 2/1983 | Nieh | 252/389 |
| 4,372,873 | 2/1983 | Nieh | 252/389 |
| 4,405,584 | 9/1983 | Foroulis | 252/389 |

OTHER PUBLICATIONS

Greene; "Mechanism and Application of Oxidizing Inhibitors", *Materials Performance,* Mar. 1982, pp. 20–22.

Lizalovs: "Molybdates and Corrosion Inhibitors in the Presence of Chlorides", *Corrosion,* 32, pp. 263–266, (1976).

Fischer, "Studies on the Passivating Effect of Organic Oxidizing Agents or on Iron in Neutral and Slightly Acid Solutions. Part 2, Aromatic Nitro Compounds", Werkstoffe and Korrosion, vol. 28, pp. 470–475, (1977).

*Primary Examiner*—Werren B. Lone

*Attorney, Agent, or Firm*—Jean B. Mauro

[57] ABSTRACT

Corrosion of metallic surfaces by aqueous alkanolamine solutions employed in acid gas removal is inhibited by combinations of particular vanadium compounds and an organic compound selected from the group consisting of nitro-substituted aromatic acids, nitro-substituted acid salts, and 1,4-naphthoquinone, preferably from the group consisting of p-nitrobenzoic acid, m-nitrobenzoic acid, 3,5-dinitrobenzoic acid, p-nitrophenol, m-nitrophenol, m-nitrobenzenesulfonic acid, 1,4-naphthoquinone, and mixtures thereof.

37 Claims, No Drawings

CORROSION INHIBITORS FOR ALKANOLAMINE GAS TREATING SYSTEMS

This is a continuation of application Ser. No. 163,975, filed June 30, 1980 now abandoned.

BACKGROUND OF THE INVENTION

This invention relates to novel corrosion inhibitors for alkanolamine gas treating systems.

Gases such as natural gas, flue gas, and synthesis gas have been purified by the utilization of aqueous alkanolamine solutions for the absorption of acid gases such as $CO_2$, $H_2S$, and COS contained in the gas stream. Ordinarily, a 5 percent to 30 percent by weight alkanolamine solution (e.g., a monoethanolamine solution), flowing countercurrently to the gas stream in an absorption column, is used to remove the acid gases. The process is a continuous and cyclic one which can be reversed at higher temperatures by desorbing the acid gases from the alkanolamine solution.

When steel parts or components are used in such a system, they are subject to both general and local corrosive attack. This is a particular problem in reboilers and heat exchangers where the steel is exposed to a hot, protonated alkanolamine solution. A heat-transferring metal surface appears to be especially vulnerable. Previous investigations by others have revealed that under certain conditions, corrosive products such as aminoacetic; glycolic, oxalic, and formic acids were formed. The alkanolamine salts of these acids present the possibility of increased attack upon ferrous metals. Furthermore, the carbonate salt of monoethanolamine can be converted to additional products such as N-(2-hydroxyethyl)-ethylenediamine which has been found to increase the corrosiveness of the amine solution towards steel, particularly under heat transfer conditions.

There are various alternatives available in order to decrease corrosion rates, among them (1) the provision of a side-stream reclaimer to remove corrosive degradation products, (2) the employment of more corrosion-resistant materials, (3) greater control of the process conditions, and (4) the inclusion of corrosion inhibitors. From both cost and efficiency standpoints, the last alternative is preferred.

Various corrosion inhibitors have been suggested for inhibiting the corrosion of metals in contact with acid-gas absorbing media. For example:

U.S. Pat. No. 4,071,470 discloses a circulating absorbent medium method for inhibiting the corrosion of metals in contact therewith by introducing into said medium a product derived from the reaction of a monoalkanolamine at from about 21° C. to about 100° C., with sulfur or a sulfide and an oxidizing agent, along with copper or a copper salt, sulfide or oxide, for from 0.1 to about 20 hours, until the resulting mixture is stable when diluted with water;

U.S. Pat. No. 4,096,085 discloses a corrosion inhibited aqueous N-methyldiethanolamine or diethanolamine acid gas treating solution consisting essentially of (1) an amine compound or mixture of amine compounds chosen from a particular class of amine compounds; said compound being present in about 10 to about 2000 parts per million parts treating solution; (2) copper or a copper ion yielding compound in from 0 to 1000 ppm; and (3) sulfur or a sulfur atom yielding compound in from 0 to 1000 ppm;

U.S. Pat. Nos. 4,100,099 and 4,100,100 disclose sour gas conditioning solutions. U.S. Pat. No. 4,100,099 relates to a conditioning solution of a combination of one part by weight of a quaternary pyridinium salt and about 0.01–10 parts of a lower alkylenepolyamine, a corresponding polyalkylenepolyamine, or a mixture thereof wherein the alkylene units contain 2–3 carbon atoms. U.S. Pat. No. 4,100,100 relates to a conditioning solution of a quaternary pyridinium salt and about 0.001–10 parts of a thio compound which is a water-soluble thiocyanate or an organic thioamide, and, in addition to the above, a small but effective amount of cobalt, said coablt present as a dissolved divalent cobalt compound; and U.S. Pat. No. 4,143,119 discloses corrosion inhibitor compositions for ferrous metal and its alloys for absorbent alkanolamine solutions in contact therewith. wherein said compositions consist essentially of (a) a source of copper ion selected from the group consisting of copper metal, copper sulfide, and copper salts; (b) a source of sulfur atoms selected from the group consisting of (1) sulfur or (2) hydrogen sulfide and/or COS; and (c) an oxidizing agent which will produce in solution the sulfur atom and at least some polysulfide.

In addition to the aforementioned art, two corrosion inhibited compositions have been disclosed in U.S. Pat. No. 3,896,044 and U.S. Pat. No. 3,808,140.

U.S. Pat. No. 3,896,044 discloses a corrosion inhibited composition consisting essentially of an aqueous alkanolamine solution and an inhibiting amount of a corrosion inhibitor selected from the class of nitro-substituted aromatic acids and nitro-substituted acid salts.

U.S. Pat. No. 3,808,140 discloses a corrosion inhibited composition consisting essentially of an aqueous alkanolamine solution and an inhibiting amount of a combination of a vanadium compound in the plus five valence state and an antimony compound.

The above patents do not disclose the synergistic combination of this invention, i.e. the synergistic combination of an organic compound selected from the group consisting of nitro-substituted aromatic acids and nitro-substituted acid salts, 1,4-naphthoquinone, and mixtures thereof, and particular vanadium compounds wherein the vanadium therein is in the plus four or plus five valence state. In fact, U.S. Pat. No. 3,808,140 claims that only vanadium compounds in the plus five valence state may be employed as effective corrosion inhibitors and then only when employed with antimony compounds.

SUMMARY OF THE INVENTION

It has now been found that the corrosion of metallic surfaces by aqueous alkanolamine solutions employed in acid gas removal service, particularly when at least a portion of the acid gas is hydrogen sulfide, can be inhibited by an inhibiting amount of a corrosion inhibitor comprising synergistic combinations of particular vanadium compounds wherein the vanadium therein is in the plus four or plus five valence state and an organic compound selected from the group consisting of nitro-substituted aromatic acids, nitro-substituted acid salts, 1,4-naphthoquinone, and mixtures thereof. The organic compound is preferably selected from the group consisting of p-nitrobenzoic acid, m-nitrobenzoic acid, 3,5-dinitrobenzoic acid, p-nitrophenol, m-nitrophenol, m-nitrobenzenesulfonic acid, 1,4-naphthoquinone and mixtures thereof. The inhibiting amounts of the vanadium compound and organic compound employed may each be less than the amount of vanadium compound or organic compound that when employed alone provides protection, although other beneficial results are believed to occur when the combination of these compounds is employed in higher concentrations. The corrosion inhibitors described herein are especially useful in aqueous monoethanolamine scrubbers employed for removing hydrogen sufide and carbon dioxide in natural gas treating systems.

It has been found that in spite of the failure of the vanadium compounds and the organic compounds to individually provide protection at amounts below their individual inhibiting amounts that the combination of the two additives surprisingly provides protection at these concentrations.

The choice of vanadium compounds in this invention is not critical since it is the vanadium therein in the plus 4 or 5 valance state, preferably plus 5, which provides this unusual corrosion inhibiting property in combination with the organic compounds. Thus, for example, one can employ $V_2O_5$, $NaVO_3$, $Na_3VO_4$, $KVO_3$, $NH_4VO_3$, $VOCl_3$, $VOSO_4$, $VO_2$, $VOCl_2$, the like and mixtures thereof.

The organic compounds employed as corrosion inhibitors in combination with the aforementioned vanadium compounds are selected from the group consisting of nitro-substituted aromatic acids, nitro-substituted acid salts, and 1,4-naphthoquinone, and preferably selected from the group consisting of pnitrobenzoic acid, m-nitrobenzoic acid, 3,5-dinitrobenzoic acid, p-nitrophenol, m-nitrophenol, m-nitrobenzenesulfonic acid, 1,4-naphthoquinone, and mixtures thereof.

For an individual corrosion inhibitor the effect of concentration of inhibitor is generally monotonic, i.e., the inhibitor fails to provide protection from corrosion below a minimum concentration, while above this concentration it always provides protection. This critical concentration is referred to as the minimum effective concentration (hereinafter the m.e.c.) for the inhibitor. The m.e.c. for an individual inhibitor may be determined simply by testing the inhibitor at various concentrations to determine the minimum concentration required to provide protection. It has been found that the combination of the vanadium compounds and the organic compounds of this invention at concentrations below these minimum effective concentrations provides protection surprisingly superior to each one alone at the same concentration. Further, it is believed that when the vanadium compound(s) and organic compound(s) are employed in combination in an amount above their individual minimum effective concentrations that other advantageous results are obtained.

The concentrations of the vanadium compounds and organic compounds may each vary from about 0.01 mM to about 50 mM. The synergistic combinations of the particular vanadium compound and the organic compound are generally added in an amount to provide a concentration of from about 0.01 mM to about 1 mM for the vanadium compound and in an amount to provide a concentration of from about 0.1 mM to about 10 mM for the organic compound, and preferably in an inhibiting amount to provide a concentration for both the vanadium compound(s) and organic compound(s) less than each of their respective minimum effective concentrations.

Alkanolamine systems which are benefited by the inclusion of the instant combined corrosion inhibitor are those mono- and polyalkanolamines having 2 to 4 carbon atoms per hydroxyalkyl moiety. Typical alkanolamines are monoethanolamine, diethanolamine, and monoisopropanolamine.

The corrosion inhibitors of the instant invention were tested in monoethanolamine-water-carbon dioxidehydrogen sulfide solutions because, while aqueous monoethanolamine solutions are not corrosive towards ferrous metals, when saturated with carbon dioxide and/or hydrogen sulfide they become quite corrosive to mild steel. It is thought that electrochemical corrosion is involved with the anodic reaction expected to produce products such as ferrous hydroxide, ferrous carbonate, ferrous sulfide, or certain complexes.

When hydrogen sulfide is present in the inhibited alkanolamine solution, it is believed to undergo a series of complex reactions which produce sulfur, which in these solutions exists at least partly as polysulfide. Sulfur formed in the alkanolamine solution may also act as a passivator.

The ability of a given corrosion inhibitor to provide protection was determined by measuring the relative corrosion rate for the alkanolamine solution containing the inhibitor and by measuring the steel's potential at the end of the test to determine whether the steel was active or passive. The relative corrosion rate for a particular alkanolamine solution is the corrosion rate of the alkanolamine solution with the inhibitor divided by the corrosion rate of the alkanolamine solution without the inhibitor. The corrosion rate in each case is calculated by determining the weight loss of a metal sample after conducting the test for a given period of time. A relative corrosion rate greater than about $0.5 \pm 0.1$ is considered to indicate that the inhibitor failed to provide protection. The potential of the steel was measured at the end of each test. A potential more positive than about $-500$ mV at 20° C. is considered to indicate that the steel is passive and that the inhibitor has provided protection.

Heat transfer corrosion tests were conducted as follows: A circular coupon of cold-rolled mild steel about 3.5 inches in diameter and 1/32 inch thick was cleaned and weighed. The coupon was then clamped to a borosilicate glass corrosion cell so as to form the bottom surface of the cell. The corrosion cell was charged with 30 percent by weight monoethanolamine solution saturated with carbon dioxide. Any residual air was purged from the cell with carbon dioxide. The steel coupon was made active by electrochemically reducing its air-formed passive film. Alternatively, if it is desired to have a passive steel coupon, this electrochemical reduction is omitted. A sample of 30 percent by weight monoethanolamine solution saturated with hydrogen sulfide is introduced anaerobically into the the corrosion cell. The volume of this sample is about 25 percent of the volume of the monoethanolamine-carbon dioxide employed initially to charge the corrosion cell. (The monoethanolamine saturated with hydrogen sulfide is prepared from carefully purified hydrogen sulfide to assure that sulfur, which might otherwise be an adventitious inhibitor, is not present). By this method, active steel is prepared under 30 percent monoethanolamine saturated with a mixture of about 20 percent by weight hydrogen sulfide and about 80 percent by weight carbon dioxide with the careful exclusion of oxygen, which might oxidize hydrogen sulfide to sulfur. The purging gas is now changed from carbon dioxide to a gas containing about 20 percent by volume hydrogen sulfide and about 80 percent by volume carbon dioxide. The corrosion cell is now ready to test the inhibition of cold active steel, and if this is desired test, the inhibitor is injected anerobically and the cell is heated through the test coupon to reflux temperature. Alternatively, the inhibition of hot active steel may be tested by heating the corrosion cell to reflux prior to introduction of the inhibitor being tested. At the end of the test period, the mixed hydrogen sulfide and carbon dioxide purge gas is replaced by carbon dioxide and the cell is permitted to cool. The potential of the steel test coupon is then remeasured. The steel coupon is cleaned of corrosion rate is then calculated.

The above-described test procedure was used to conduct the following Examples which are representative of the invention. Comparative examples are provided. Failure of an inhibitor at a given concentration is indicated in Tables I and II by placing the concentrations of the inhibitor in parentheses.

EXAMPLES 1-31

In these examples, the corrosion inhibitors of this invention are tested. Examples 1-31 were all conducted on hot active steel under hydrogen sulfide and carbon dioxide for twenty-four hours per the previously described procedure. In each example, the vanadium was added before adding the other inhibitor.

The corrosion rate of unhibited monoethanolaminewater-carbon dioxide-hydrogen sulfide solutions was initially determined by carrying out tests on twenty-nine steel coupons without adding a corrosion inhibitor. Each test coupon showed a weight loss that corresponded to a corrosion rate of $9.0 \pm 1.4$ mil/year in the one-day tests and a corrosion rate of $4.1 \pm 1.0$ mil/year in the eight-day tests. These corrosion rates were employed to calculate the relative corrosion rates of all the examples in Tables I and II. These corrosion rates shown that the efforts to exclude adventitious inhibitors from the tests were successful.

The vanadium compound used in Examples 1-47 was either $V_2O_5$ or $NaVO_3$.

Table I shows the results obtained by employing the combined corrosion inhibitors of the invention at concentrations where each inhibitor alone fails to provide protection but when employed together the combination provides protection. Examples 1-7 show the superior protection provided by the combined inhibitor. Examples 1-3 show vanadium (V) has an m.e.c. between about 0.2 and about 0.3 mM when used alone on hot active steel. Examples 4-6 show that the m.e.c. for p-nitrobenzoic acid is between about 10 and 20 mM on hot active steel. Example 7 shows the superior protection that the combination of 0.1 mM vanadium (V) and 1.0 mM p-nitrobenzoic acid provides for hot active steel. Similar results are shown in examples 8-31 for vanadium (V) in combination with m-nitrophenol, m-nitrobenzenesulfonic acid, 1,4-naphthoquinone, p-nitrophenol, m-nitrobenzoic acid, and 3,5-dinitrobenzoic acid.

TABLE I

| Example | Relative Corrosion Rate | Steel[10] Potential | Con. of Vanadium(V) compound (mM) | Con. of[1] Organic Compound (mM) | Organic Compound |
|---|---|---|---|---|---|
| 1 | 0.35 | —[9] | 0.3 | — | — |
| 2 | 1.04 | A | (0.2) | — | — |
| 3 | 1.19 | A | (0.1) | — | — |
| 4 | 0.42 | P | | 20 | PNBA[2] |
| 5 | 3.12 | A | | (10) | PNBA |

TABLE I-continued

| Example | Relative Corrosion Rate | Steel[10] Potential | Con. of Vanadium(V) compound (mM) | Con. of[1] Organic Compound (mM) | Organic Compound |
|---|---|---|---|---|---|
| 6 | 1.58 | A | | (4) | PNBA |
| 7 | 0.42 | P | 0.1 | 1.0 | PNBA |
| 8 | 1.65 | A | | (20) | MNP[3] |
| 9 | 1.54 | A | | (4) | MNP |
| 10 | 0.54 | P | 0.1 | 10 | |
| 11 | 6.96 | A | | (20) | MNBS[4] |
| 12 | 0.42 | P | 0.1 | 10 | MNBS |
| 13 | 0.38 | P | | 20 | 4NQ[5] |
| 14 | 0.42 | P | | 10 | 4NQ |
| 15 | 1.38 | A | | (4) | 4NQ |
| 16 | 0.42 | P | 0.1 | 2 | 4NQ |
| 17 | 0.38 | P | | 4 | NP[6] |
| 18 | 0.38 | P | | 2 | NP |
| 19 | 2.19 | A | | (1) | NP |
| 20 | 0.46 | P | 0.1 | 0.4 | NP |
| 21 | 0.31 | P | | 20 | MNBA[7] |
| 22 | 5.88 | A | | (10) | MNBA |
| 23 | 0.96 | A | | (4) | MNBA |
| 24 | 0.50 | P | 0.1 | 4 | MNBA |
| 25 | 0.42 | P | | 20 | DNBA[8] |
| 26 | 0.46 | P | | 10 | DNBA |
| 27 | 0.38 | P | | 4 | DNBA |
| 28 | 1.12 | A | | (2) | DNBA |
| 29 | 0.46 | A | | (1) | DNBA |
| 30 | 0.77 | A | | (0.4) | DNBA |
| 31 | 0.38 | P | 0.1 | 1 | DNBA |

[1]A number in parentheses indicates the failure of that concentration of inhibitor to provide protection.
[2]p-nitrobenzoic acid
[3]m-nitrophenol
[4]m-nitrobenzenesulfonic acid
[5]1,4-naphthaquinone
[6]p-nitrophenol
[7]m-nitrobenzoic acid
[8]3,5-dinitrobenzoic acid
[9]The potential of the steel was not measured for this example.
[10]A is active and P is passive.

EXAMPLES 32-47

In these examples, the inhibiting effect of the combination of vanadium (V) and p-nitrobenzoic acid was evaluated by the above-described general procedure, except that the heat transfer tests were carried out for eight days, i.e., 192 hours.

Table II shows the protection realized with the vanadium (V)-p-nitrobenzoic acid combination. In addition, Table II shows that at concentrations in excess of those employed for the combined inhibitors that the individual additives failed to provide protection.

The examples in Table II show that the combination of vanadium (V) and p-nitrobenzoic acid provides protection when the vanadium (V) is at a concentration of from about 0.02 mM to about 0.25 mM and when the p-nitrobenzoic acid is at a concentration of from about 0.6 mM to about 8.0 mM. When employed at these concentrations, the combinations of vanadium (V) and p-nitrobenzoic acid provides protection even though the m.e.c. for each additive is not employed.

TABLE II

| Example | Relative Corrosion Rate | Steel Potential | Vanadium(V) (mM) | p-nitrobenzoic acid (mM) |
|---|---|---|---|---|
| 32 | 0.17 | P | 1.0 | — |
| 33 | 0.17 | P | 0.5 | — |
| 34 | 1.06 | A | (0.2) | — |
| 35 | 0.68 | A | (0.1) | — |
| 36 | 0.20 | P | — | 20 |
| 37 | 0.18 | P | — | 10 |
| 38 | 1.64 | A | — | (5) |
| 39 | 2.11 | A | — | (2) |

TABLE II-continued

| Example | Relative Corrosion Rate | Steel Potential | Vanadium(V) (mM) | p-nitro-benzoic acid (mM) |
|---|---|---|---|---|
| 40 | 0.23 | P | 0.1 | 5 |
| 41 | 0.20 | P | 0.02 | 5 |
| 42 | 0.12 | P | 0.05 | 2 |
| 43 | 0.16 | | 0.1 | 1 |
| 44 | 0.06 | P | 0.02 | 1 |
| 45(1) | 0.95 | A | (0.05) | (0.5) |
| 46(1) | 0.88 | A | (0.1) | (0.2) |
| 47(1) | 0.86 | A | (0.02) | (0.2) |

(1)Examples 45–47 show that a minimum inhibiting amount of inhibitor must be employed.

What is claimed is:

1. A corrosion inhibitor, in acid gas removal service, suitable for inhibiting corrosive aqueous alkanolamine solutions in contact with a metallic surface comprising an inhibiting amount of the synergistic combination of at least one vanadium compound wherein the vanadium therein is in the plus five valence state in the aqueous alkanolamine solution and an organic compound selected from the group consisting of nitro-substituted aromatic acids, nitrosubstituted aromatic acid salts, and mixtures thereof; wherein at least a portion of the acid gas is hydrogen sulfide.

2. Composition claimed in claim 1 wherein the organic compound is selected from the group consisting of p-nitrobenzoic acid, m-nitrobenzoic acid, 3,5-dinitrobenzoic acid, p-nitrophenol, m-nitrophenol, m-nitrobezenesulfonic acid, and mixtures thereof.

3. Composition claimed in claim 2 wherein the vanadium compound is an inorganic vanadium compound.

4. Composition claimed in claim 3 wherein the vanadium compound is selected from the group consisting of $V_2O_5$, $NaVO_3$, $Na_3VO_4$, $KVO_3$, $NH_4VO_3$, $VOCl_3$, and mixtures thereof.

5. Composition claimed in claim 2 wherein the organic compoiund is p-nitrobenzoic acid.

6. Composition claimed in claims 1 or 2 or 3 wherein the vanadium compound and the organic compound are each employed in an amount less than their individual minimum effective concentration.

7. Composition claimed in claim 3, which comprises a vanadium compound wherein the vanadium therein is in the plus five valence state in a concentration of from about 0.02 mM to about 0.25 mM and p-nitrobenzoic acid in a concentration of from about 0.6 mM to about 8.0 mM.

8. Composition claimed in claim 4 wherein the vanadium compound is selected from the group consisting of $V_2O_5$ and $NaVO_3$.

9. Composition claimed in claim 1 wherein said aqueous alkanolamine solution therein is an aqueous monoethanolamine solution.

10. The corrosion inhibitor of claim 1 comprising an inhibiting amount of the synergistic combination of $NaVO_3$ and p-nitrobenzoic acid.

11. The corrosion inhibitor claimed in claim 4 wherein the vanadium compound is selected from the group consisting of $V_2O_5$ and $NaVO_3$.

12. Method for inhibiting corrosion of metallic surfaces, in acid gas removal service, by a corrosive aqueous alkanolamine solution comprising adding to said aqueous alkanolamine solution an inhibiting amount of a corrosion inhibitor selected from the synergistic combination of a vanadium comopound wherein the vanadium therein is in the plus five valence state in said aqueous alkanolamine solution or mixtures thereof and an organic compound selected from the group consisting of nitro-substituted aromatic acids, nitro-substituted aromatic acid salts, and mixtures thereof; wherein at least a portion of the acid gas is hydrogen sulfide.

13. Method claimed in claim 12 wherein the vanadium compound is an inorganic vanadium compound.

14. Method claimed in claim 12 wherein said organic compound therein is selected from the group consisting of p-nitrobenzoic acid, m-nitrobenzoic acid, 3,5-dinitrobenzoic acid, p-nitrophenol, m-nitrophenol, m-nitrobenzenesulfonic acid, and mixtures thereof.

15. Method claimed in claims 12 or 14 or 13 wherein the vanadium compound and the organic compound are each employed in an amount less than their individual minimum effective concentration.

16. Method claimed in claim 12 wherein said aqueous alkanolamine solution is an aqueous monoethanolamine solution.

17. Method claimed in claim 12 which comprises a vanadium (V) compound in a concentration of from about 0.2 mM to about 0.25 mM and p-nitrobenzoic acid in a concentration of from about 0.6 mM to about 8.0 mM.

18. Method claimed in claim 12 wherein the vanadium compound is selected from the group consisting of $V_2O_5$, $NaVO_3$, $Na_3VO_4$, $KVO_3$, $NH_4VO_3$, $VOCl_3$, and mixtures thereof.

19. The method of claim 14 wherein the vanadium compound is selected from the group consisting of $V_2O_5$ and $NaVO_3$.

20. A corrosion inhibitor, in acid gas removal service, suitable for inhibiting corrosive aqueous alkanolamine solutions in contact with a metallic surface comprising an inhibiting amount of the synergistic combination of at least one vanadium compound wherein the vanadium therein is in the plus five valence state in the aqueous alkanolamine solution and an organic compound selected from the group consisting of nitro-substituted aromatic acids, nitro-substituted aromatic acid salts, and mixtures thereof.

21. Composition claimed in claim 20 wherein the organic compound is selected from the group consisting of p-nitrobenzoic acid, m-nitrobenzoic acid, 3,5-dinitrobenzoic acid, p-nitrophenol, m-nitrophenol, m-nitrobenzenesulfonic acid, and mixtures thereof.

22. Composition claimed in claim 20 wherein the organic compound is p-nitrobenzoic acid.

23. Composition claimed in claim 20, which comprises a vanadium compound wherein the vanadium therein is in the plus five valence state in a concentration of from about 0.02 mM to about 0.25 mM and p-nitrobenzoic acid in a concentration of from about 0.6 mM to about 8.0 mM.

24. Composition claimed in claim 20 wherein said aqueous alkanolamine solution therein is an aqueous monoethanolamine solution.

25. The corrosion inhibitor of claim 20 comprising an inhibiting amount of the synergistic combination of $NaVO_3$ and p-nitrobenzoic acid.

26. Composition claimed in claim 20 wherein the vanadium compound is an inorganic vanadium compound.

27. Composition claimed in claim 25 wherein the vanadium compound is selectfed from the group consisting of $V_2O_5$, $NaVO_3$, $Na_3VO_4$, $KVO_3$, $NH_4VO_3$, $VOCl_3$, and mixtures thereof.

28. Composition claimed in claims 20 or 21 or 26 wherein the vanadium compound and the organic compound are each employed in an amount less than their individual minimum effective concentration.

29. The corrosion inhibitor claimed in claim 27 wherein the vanadium compound is selected from the group consisting of $V_2O_5$ and $NaVO_3$.

30. Method for inhibiting corrosion of metallic surfaces, in acid gas removal service, by a corrosive aqueous alkanolamine solution comprising adding to said aqueous alkanolamine solution an inhibiting amount of a corrosion inhibitor selected from the synergistic combination of a vanadium compound wherein the vanadium therein is in the plus five valence state in said aqueous alkanolamine solution and an organic compound selected from the group consisting of nitrosubstituted aromatic acids, nitro-substituted aromatic acids salts, and mixtures thereof.

31. Method claimed in claim 30 wherein said organic compound therein is selected from the group consisting of p-nitrobenzoic acid, m-nitrobenzoic acid, 3,5-dinitrobenzoic acid, p-nitrophenol, m-nitrophenol, m-nitrobenzenesulfonic acid, and mixtures thereof.

32. Method claimed in claim 30 wherein said aqueous alkanolamine solution is an aqueous monoethanolamine solution.

33. Method claimed in claim 30 which comprises a vanadium (V) compound in a concentration of from about 0.01 mM to about 0.25 mM and p-nitrobenzoic acid in a concentration of from about 0.6 mM to about 8.0 mM.

34. Method claimed in claim 30 wherein the vanadium compound is an inorganic vanadium compound.

35. Method claimed in claim 34 wherein the vanadium compound is selected from the group consisting of $V_2O_5$, $NaVO_3$, $Na_3VO_4$, $KVO_3$, $NH_4VO_3$, $VOCl_3$, and mixtures thereof.

36. Method claimed in claim 35 wherein the vanadium comopound is selected from the group consisting of $V_2O_5$ and $NaVO_3$.

37. Method claimed in claims 30 or 31 or 34 wherein the vanadium compound and the organic compound are each employed in an amount less than their individual minimum effective concentration.

* * * * *